US008985409B2

(12) United States Patent
Willows et al.

(10) Patent No.: US 8,985,409 B2
(45) Date of Patent: Mar. 24, 2015

(54) BOTTLE AND ACCESSORIES CARRIER

(75) Inventors: Keith Willows, Seattle, WA (US); June Angus, Seattle, WA (US); Antonio Del Rosario, Bellevue, WA (US)

(73) Assignee: Amphipod, Inc., Seattle, WA (US)

( * ) Notice: Subject to any disclaimer, the term of this patent is extended or adjusted under 35 U.S.C. 154(b) by 862 days.

(21) Appl. No.: 12/582,382

(22) Filed: Oct. 20, 2009

(65) Prior Publication Data

US 2010/0102096 A1 Apr. 29, 2010

Related U.S. Application Data

(60) Provisional application No. 61/197,202, filed on Oct. 23, 2008.

(51) Int. Cl.

| | |
|---|---|
| ***A45F 5/00*** | (2006.01) |
| ***A45F 3/16*** | (2006.01) |
| ***A45F 3/14*** | (2006.01) |
| *A45F 3/00* | (2006.01) |

(52) U.S. Cl.

CPC . *A45F 3/14* (2013.01); *A45F 3/005* (2013.01); *A45F 3/16* (2013.01); *A45F 5/00* (2013.01); *A45F 2003/144* (2013.01); *A45F 2200/0583* (2013.01)

USPC ..... 224/148.4; 224/148.1; 224/664; 224/684

(58) Field of Classification Search

USPC ..... 224/148.1, 148.3–148.5, 148.7, 196, 224/223, 664, 684, 904

See application file for complete search history.

(56) References Cited

U.S. PATENT DOCUMENTS

| | | | | |
|---|---|---|---|---|
| D219,954 | S | | 2/1971 | Koenigsberg |
| 4,176,772 | A | | 12/1979 | Danon |
| 4,197,890 | A | | 4/1980 | Simko |
| D257,409 | S | | 10/1980 | Kishbaugh et al. |
| D300,904 | S | | 5/1989 | Pardo et al. |
| 4,974,762 | A | | 12/1990 | Boretsky et al. |
| 4,993,565 | A | | 2/1991 | Ota et al. |
| D318,798 | S | | 8/1991 | Biesecker |
| D320,455 | S | | 10/1991 | Malcolm |
| 5,150,824 | A | * | 9/1992 | Alvarez et al. ..... 224/586 |
| 5,209,385 | A | * | 5/1993 | Ledesma ..... 224/681 |
| 5,427,290 | A | | 6/1995 | Thatcher |
| 5,570,824 | A | | 11/1996 | Lyon et al. |
| D392,390 | S | | 3/1998 | Chan et al. |

(Continued)

FOREIGN PATENT DOCUMENTS

JP 07101517 4/1995

OTHER PUBLICATIONS

Ultimate Direction, 2002 High Performance Hydration.

(Continued)

*Primary Examiner* — J. Gregory Pickett
*Assistant Examiner* — John Cogill
(74) *Attorney, Agent, or Firm* — Lowe Graham Jones PLLC

(57) ABSTRACT

A bottle and accessories carrier generally includes a bottle carrier with preferable accessory storage. One version includes a holster portion for retaining at least one bottle or container; straps or other means attaching the holster portion onto a user's body or other article; a preferably flattened bottle; and an accessory storage area for carrying items. A strategically placed spacer or padding layer improves breathability and reduces bounce, providing a more comfortable carrier.

20 Claims, 11 Drawing Sheets

(56) References Cited

U.S. PATENT DOCUMENTS

| | | | | |
|---|---|---|---|---|
| 5,722,574 | A | 3/1998 | Pratt | |
| 5,727,720 | A * | 3/1998 | Thatcher | 224/664 |
| D393,211 | S | 4/1998 | Mengeu | |
| 5,758,790 | A | 6/1998 | Ewing, Jr. | |
| 5,772,090 | A | 6/1998 | Rodriguez | |
| 5,873,551 | A | 2/1999 | Jones | |
| 5,890,809 | A * | 4/1999 | Nelson | 383/40 |
| D410,770 | S | 6/1999 | Bergara | |
| 6,109,496 | A | 8/2000 | Andrew et al. | |
| 6,182,872 | B1 | 2/2001 | Six | |
| 6,237,820 | B1 * | 5/2001 | Saxton | 224/148.5 |
| 6,321,958 | B1 | 11/2001 | Erdmann | |
| 6,401,993 | B1 | 6/2002 | Andrino | |
| 6,405,912 | B2 | 6/2002 | Giannou | |
| 6,446,852 | B1 * | 9/2002 | Sorensen et al. | 224/661 |
| 6,454,146 | B2 | 9/2002 | Alis | |
| 6,508,391 | B2 | 1/2003 | Gilbert | |
| 6,626,342 | B1 * | 9/2003 | Gleason | 224/633 |
| 6,659,321 | B2 * | 12/2003 | Hartranft et al. | 224/683 |
| 6,971,562 | B2 | 12/2005 | Willows et al. | |
| 7,520,412 | B2 | 4/2009 | Willows et al. | |
| 2007/0175787 | A1 * | 8/2007 | Lown et al. | 206/427 |
| 2009/0224012 | A1 | 9/2009 | Willows et al. | |

OTHER PUBLICATIONS

Amphipod 2004 Catalog.

* cited by examiner

BOTTLE AND ACCESSORIES CARRIER

PRIORITY CLAIM

This application claims the benefit of prior Provisional Application Ser. No. 61/197,202, filed Oct. 23, 2008 contents of which are incorporated herein.

FIELD OF THE INVENTION

The present invention relates to a bottle, container, or fluid carrying pack, and a bottle or container, which are used to contain or carry fluids and/or personal items on one's person.

BACKGROUND OF THE INVENTION

Sport, travel and general merchandise stores commonly sell articles for holding water and hydrating fluids for use during a variety of activities to enable the user to keep one's body healthfully hydrated, ward off thirst and improve sports performance. These fluid carrying articles are used for, and during, activities from leisurely walking and everyday use to hiking and more endurance sports or activities such as running, in-line skating, triathlons and adventure racing. These articles, depending on their configuration, provide varying levels of comfort and convenience relative to the intended activity and unique/varying activity variables.

Originally, day hikers used small to large, frame-less and internal/external frame, backpacks with shoulder straps, to carry bottles of water or other containers for holding fluids in a hands-free fashion. With the increased popularity of running and fitness, waist water carriers with fabric and foam-type holsters have become popular with the need for people to carry primarily just water and basic minimal essentials. There are many variations of belts and waist packs made for carrying fluid containers readily available as well as bladder-style packs and belts. Also there are add on fabric and foam style holsters which slide on a belt with a belt loop so you can add fluid containers to an existing belt. Additionally, hand carrying a water bottle with a hand strap or just by itself is also a popular alternative to a waist pack for some people.

Although there are many solutions for carrying hydrating fluids, they suffer from drawbacks of one sort or another. The current methods for carrying fluids suffer from drawbacks and disadvantages that include: discomfort through bouncing and chafing; uncomfortable pressure points; trapping heat and sweat; less than optimal ergonomics and contouring relative to the human body; difficulty in accessing and replacement of bottle or container while in use; unreliable retainment or security of bottle in holster; awkward physics of carrying mass or fluid on the human body; inclusion of features that are difficult to use during athletic or general performance; and limited versatility for a range of uses and range of users. In general, many such methods are difficult or inconvenient to use.

SUMMARY OF THE INVENTION

The present invention generally includes a fluid or container or the like carrier with preferable accessory storage. One version includes a holster portion for retaining at least one bottle or container; straps or other means attaching the holster portion onto a user's body or other article; and a preferably flattened bottle, container or fluid carrying portion, an accessory storage area for carrying items. It further includes a strategically placed and preferably confined or fixed layer formed of preferably breathable, wicking padding or structural foam or the like components.

The preferred container and accessory carrying device can be produced having qualities of superior comfort, bounce elimination, weight savings and durability among many other positive attributes.

Additional versions of the invention include optional additional features, as discussed in greater detail with respect to the description of the preferred embodiments. These and other examples of the invention will be described in further detail below.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Exemplary preferred embodiments of the invention are illustrated in the figures and described more fully below. In some instances, the drawings are not necessarily to scale and in the cross section drawings the thickness of materials shown may be exaggerated for diagramming purposes to more clearly illustrate the manner in which the layers may be assembled. While several versions of the invention are illustrated below, certain features are similar across different versions and those features have been assigned common reference numbers in the different views, as noted below.

Figure 1:
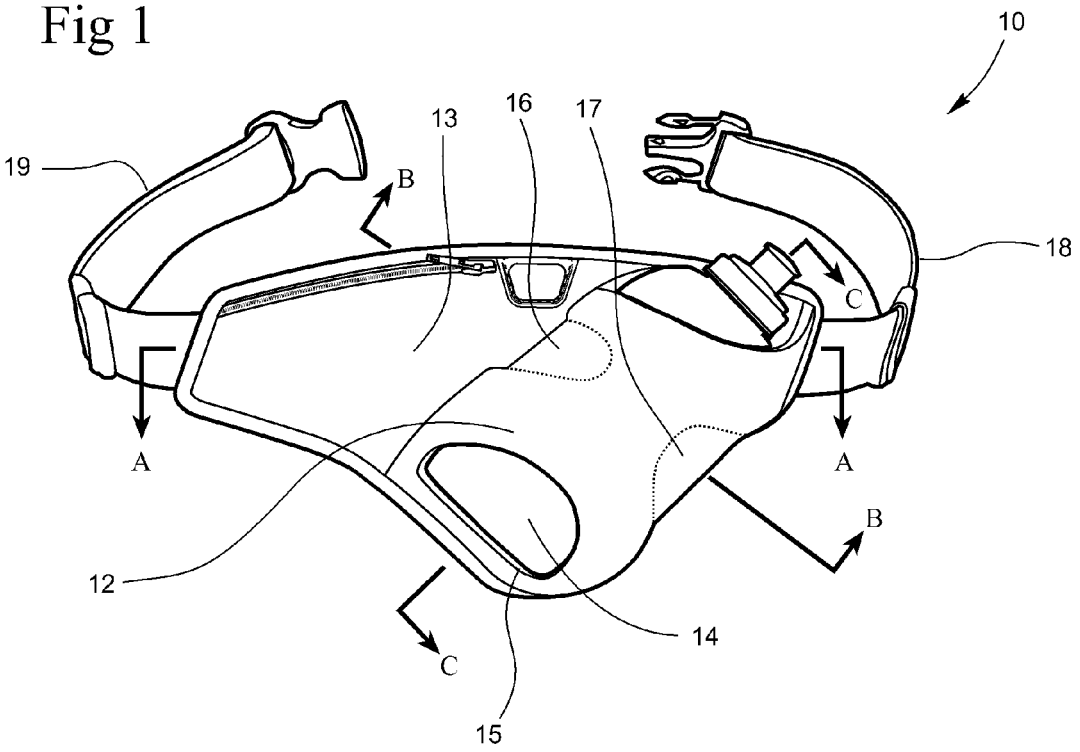
FIG. 1 shows a preferred embodiment of the invention and includes a bottle, bottle holster, straps and at least one pocket as shown.

In general, the preferred carrier 10 of FIG. 1 includes a main body 13 having a bottle holster 12 for receiving a bottle 14. The main body further includes a pair of waist straps 18, 19 extending away from the main body so that the carrier can be secured around the waist of a person. Each of the waist straps includes a means for securing the straps to one another, and in the version as shown each of the straps terminates in complementary mating clips.

The bottle holster as shown is configured to carry the bottle in a position that is preferably at a tilted angle with respect to a horizontal line defined by a line passing through the points at which the waist straps are secured to the main body. As shown, the preferred bottle holster is tilted at approximately a 45 degree angle. The bottle holster includes one or more cutouts or indentations 16, 17, as described greater below.

Figure 2:
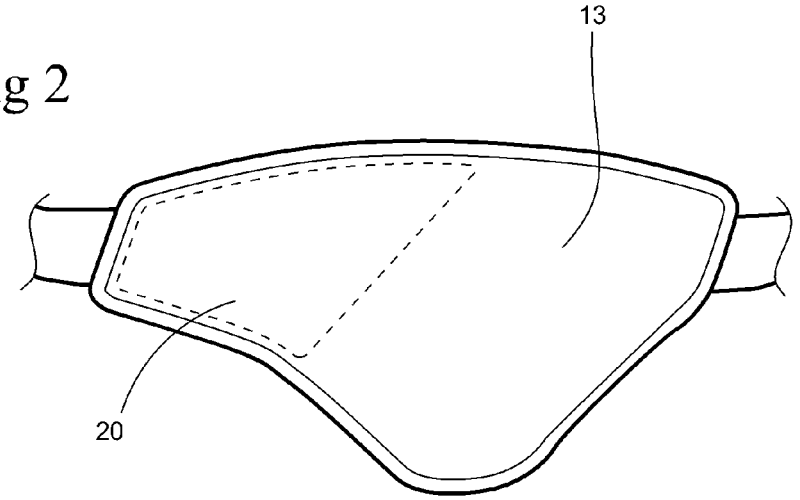
FIG. 2 shows an interior view of the embodiment shown in FIG. 1. In this view, the bottle is removed and the straps are not fully shown for simplicity of the drawing.

The main body 13 includes a front side as shown in FIG. 1, with the front side carrying the bottle holster and optionally including one or more pockets for carrying accessories. An interior view of the main body is visible in FIG. 2, with the bottle holster, pocket, and other front layers removed. A portion of the main body may include a padding layer 20, as indicated in FIG. 2, with the padding preferably being located internally, between a layer defining the back of the main body and the front of the main body.

As illustrated in the sectional views (for example, FIG. 3), the main body includes a back panel 30. The back panel 30 is preferably formed from Aerospacer or similar breathable, wicking fabric. In other versions, the back layer may comprise thin layered headliner open cell foam, terry cloth, coolmax, or some other comfort preferably wicking, breathable fabric or the like. Though illustrated as one layer of material, multiple layers may be used. Preferably this back panel has a degree of inherent thickness that provides moderate cushioning. Alternatively it may be made from more flat mesh or combination of mesh, open and/or closed cell foam, nylon, and/or other materials that provide less cushioning.

An edge binding 32 comprising soft nylon or the like material is preferably used to bind the perimeter of the waist panel. As shown, it is stitched 32*a*, 32*b*, but it may alternatively be fastened using rivets or other means.

A strategically placed cushioning or spacer layer 20 is also provided. The strategically placed cushioning/spacer 20 is preferably formed of polyurethane foam or the like but alternately could be made from a variety of methods and materials with the intended purpose of creating the desired padding/cushioning/spacing/tenting effect. This part is preferably die-cut from sheet foam material (preferably polyurethane foam but could be PE foam or the like) but also could be formed in other ways such as pressure formed, molded (expansion, foamed or otherwise) shaped. A similar tenting effect could be achieved, although not preferable because of cost of creating this locally cushioned area, by creating a structured perimeter with a plastic, foam or foamed plastic or the like with tented and preferably breathable fabric held to its perimeter such that the locally tented area creates a cushioning effect much like the way hide is stretched on a two-sided drum.

The material used for the spacer layer 20 can be breathable, open-cell, closed-cell or other but is preferably closed-cell to stop the migration of liquid into the foam. This strategically placed padding can be trapped in place but is preferably glued (face-glued or perimeter glued or the like), sewed or otherwise affixed/confined in place to an intermediate panel 34 such that it preferably does not shift out of place. As mentioned, this preferably polyurethane foam part is preferably die-cut from sheet material and is of a softness to feel good pressed against the body. It is preferably between 0.25 to 0.75 inches thick depending on the desired amount of tenting effect as well as weight, comfort, etc. Although it is not preferable for most situations, thicker or thinner foam/cushioning material or the like could be used depending on the desired result.

The spacer layer 20 preferably is formed to fit the body and to nest with the bottle's shape as well as be formed to facilitate airflow with grooves or die-cut or otherwise formed holes or the like. As illustrated for example in FIG. 2, the spacer layer 20 is formed in a shape having a perimeter that generally conforms the perimeter of the main body 13 but terminates along an edge defined by the upper side of the bottle holster such that the spacer layer is not provided between the bottle holster and the back panel 30.

Although this part is shown in the drawings as squashed down (or sculpted down) along its edges, in most situations this part is preferably simply and inexpensively die-cut with a straight simple cut as is common in the industry for foam padding.

The spacer layer includes a front side and a back side, with the back side being placed adjacent the back panel 30 and the front side being adjacent an intermediate panel 34. Thus, the spacer layer is sandwiched between the back panel and the intermediate panel. The intermediate panel 34 is preferably formed from die-cut rip-stop nylon or the like material.

Preferably, the intermediate "tenting" panel 34 is not fastened to the back panel 30 at the interior portion of the panel, but rather only along the edges or perimeter. In one version, the intermediate panel is only edge-bound to the back panel 30 around its perimeter, which is preferably also a substantial portion the perimeter of the back panel 30.

Figure 3:
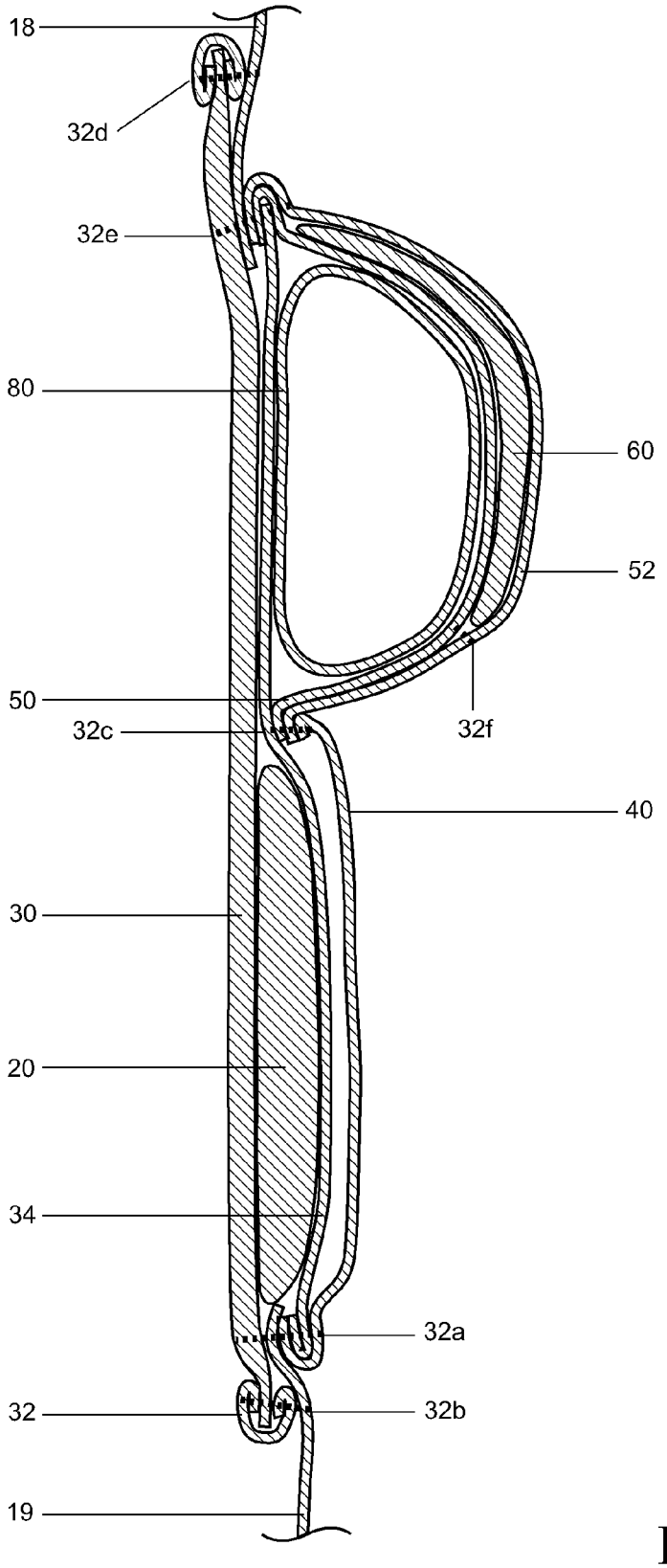
FIG. 3 is a sectional view taken along lines A-A in FIG. 1.
Figure 4:
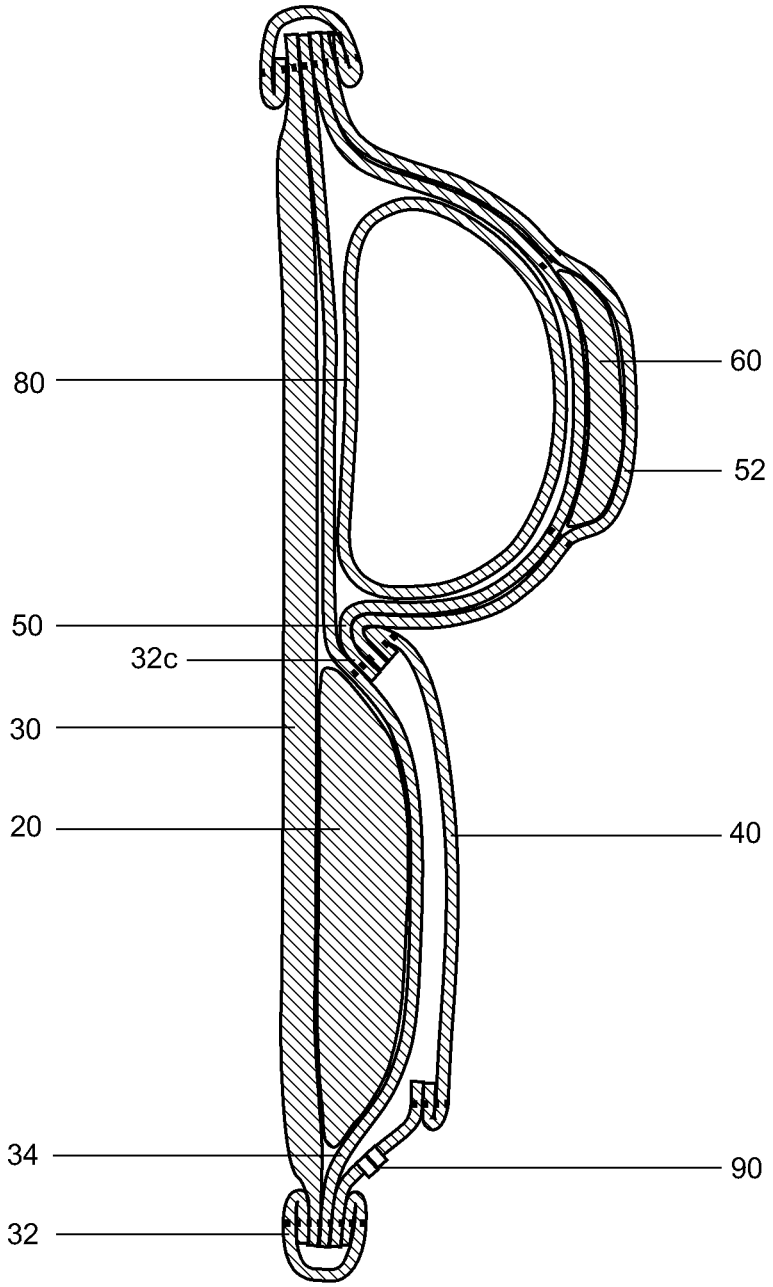
FIG. 4 is a sectional view taken along lines B-B in FIG. 1.
Figure 5:
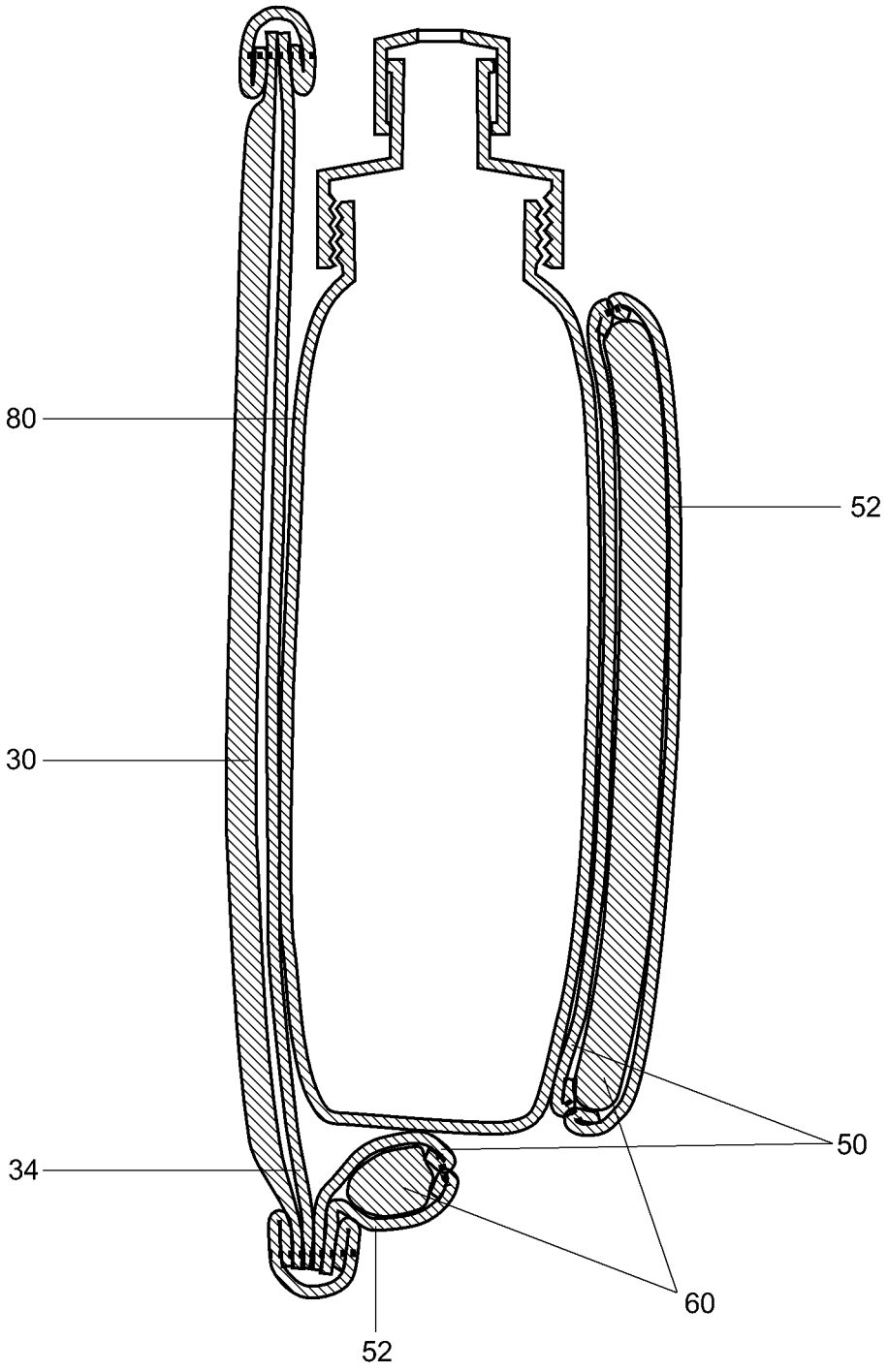
FIG. 5 is a sectional view taken along lines C-C in FIG. 1.
Figure 6:
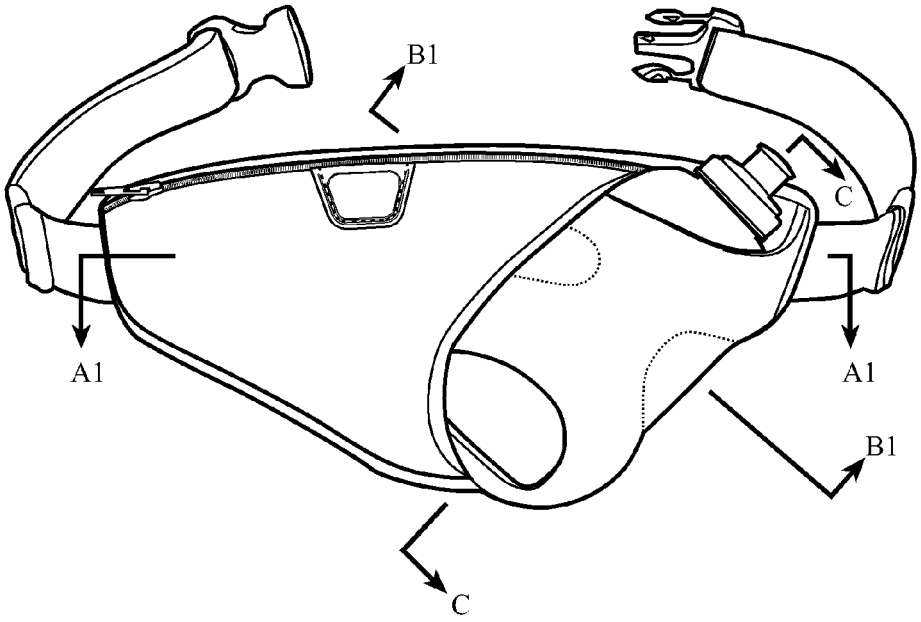
FIG. 6 shows another preferred embodiment of the invention with a larger, less flat pocket.
Figure 7:
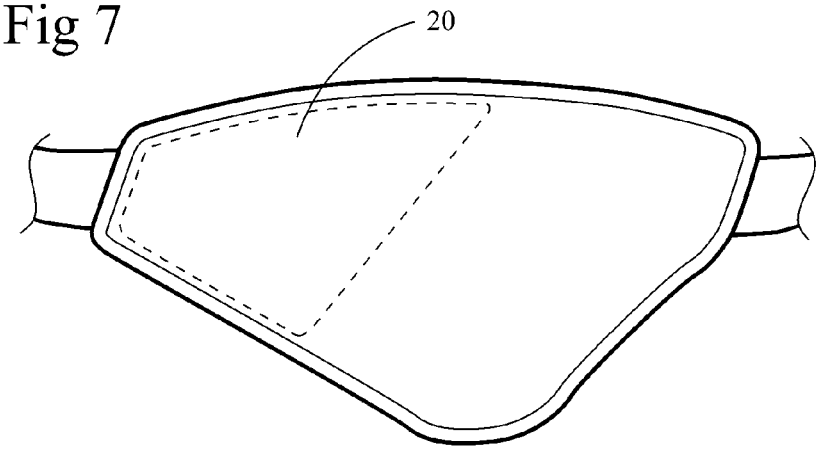
FIG. 7 shows an interior view of the embodiment shown in FIG. 6. In this view, the bottle is removed and the straps are not fully shown for simplicity of the drawing.

In versions that include a holster assembly or assemblies (such as for an accessory storage pocket) such a holster or pocket is preferably fastened to the intermediate panel 34 by stitching 32*a*, 32*c* as best seen in FIG. 3. Notably, the stitching 32*c* adjacent the bottle holster secures the holster or pocket to the intermediate layer 34 but not to the back layer 30. Because of this disclosed geometry, when the waist straps are pulled taught around a user's body the spacer layer 20 in combination with the back panel 30 and intermediate panel 34 create a "tenting" or "drum" effect which tends to cushion the bottle from the user such that the user is cushioned from the bulge of the bottle in the holster and the overall effect is a very comfortably evening out or even pressure distribution of the weight of the bottle and items carried in the accessory pocket. Another benefit of the disclosed geometry is that the back panel 30 is more effective at wicking and comfort in that it provides an air gap between the user and the bottle and thus reduces or eliminates sweaty hot spots under the bottle and across the waist panel.

In some versions of the invention, no additional front layer may be provided and the intermediate layer 34 may be used as an outer layer. In other versions, including the versions as illustrated, one or more front layers are provided and sandwich the intermediate layer between the back layer and the one or more front layers. As seen in FIG. 3, a front layer 40 is included and formed from ballistic or rip-stop nylon or the like (although it may be a formed form a variety of other materials from stretch mesh to leather or the like depending on the desired use/aesthetic, etc.). The front layer as illustrated is stitched at one end (adjacent the strap 10) to both the back layer 30 and intermediate layer 34, and at the opposite end (along the edge adjacent the bottle holster) only to the intermediate layer 34.

Figure 8:
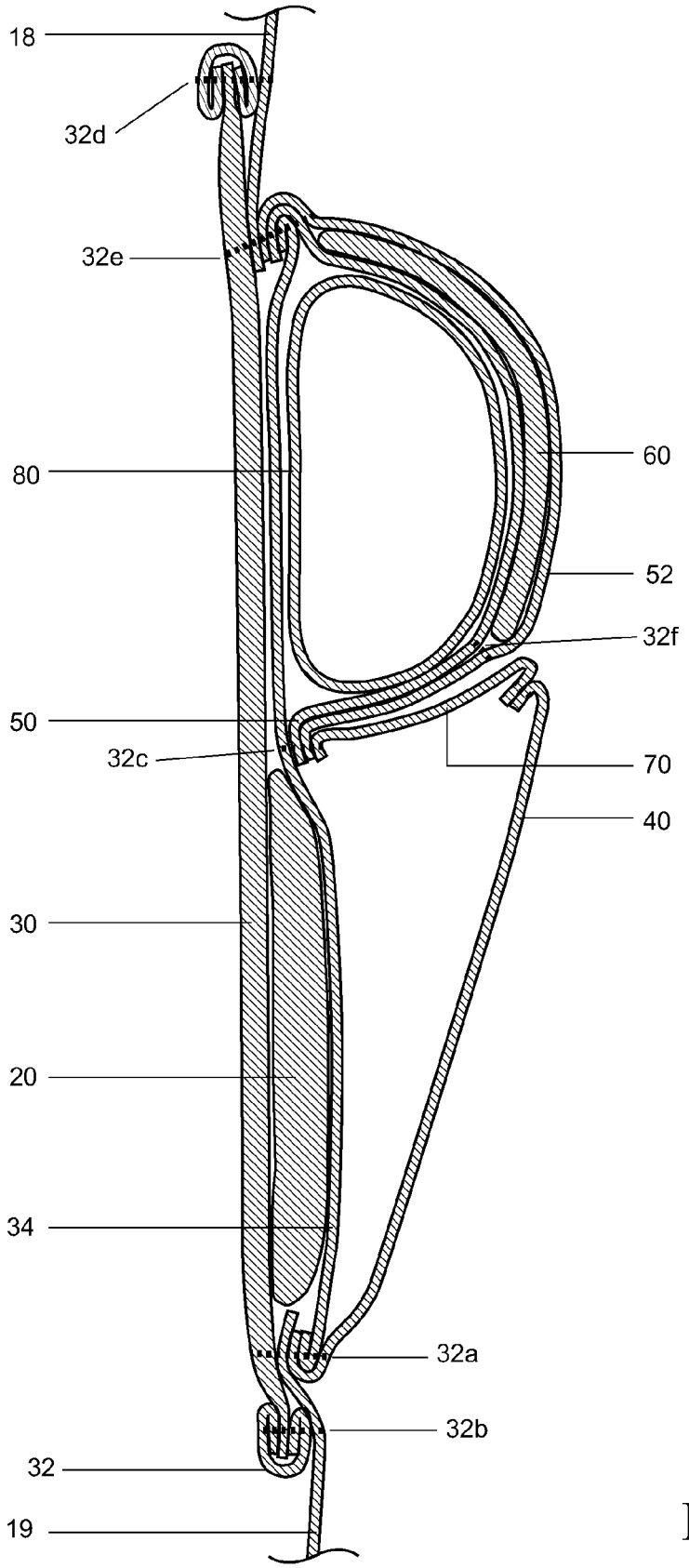
FIG. 8 is a sectional view taken along lines A1-A1 in FIG. 6.
Figure 9:
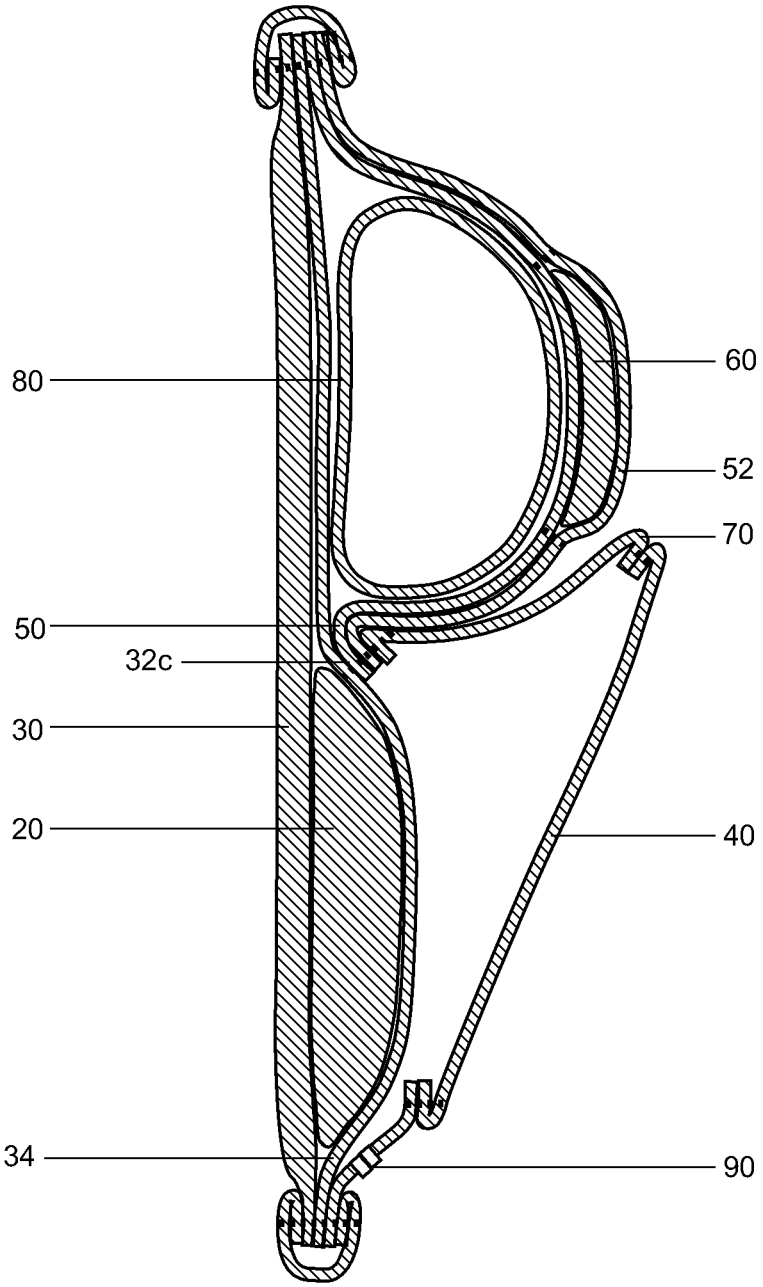
FIG. 9 is a sectional view taken along lines B1-B1 in FIG. 6.
Figure 10:
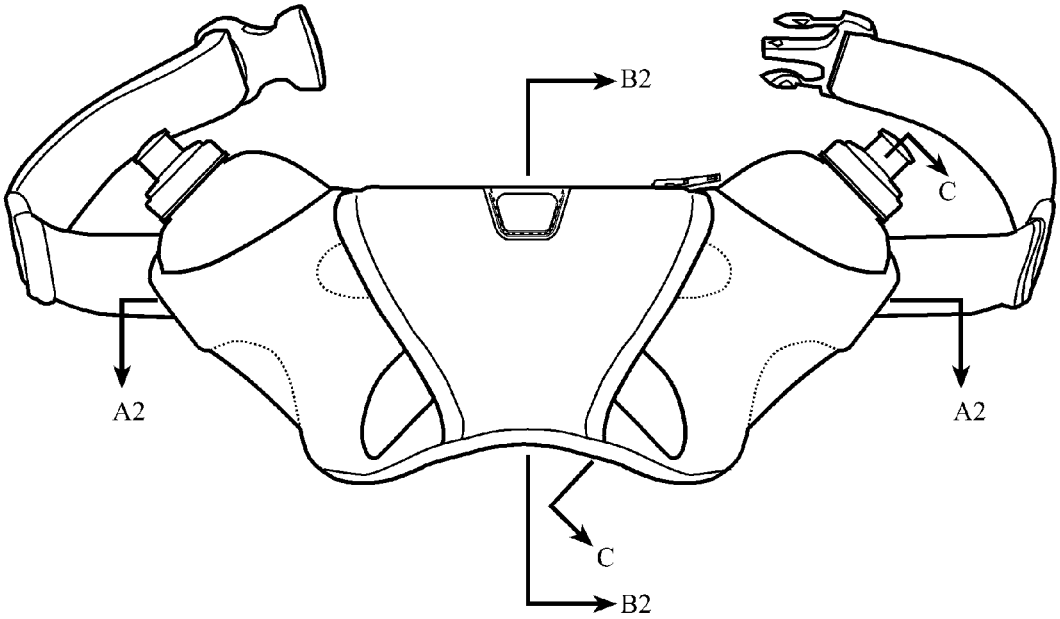
FIG. 10 shows another preferred embodiment of the invention with a large pocket and holsters for holding two bottles as shown.
Figure 11:
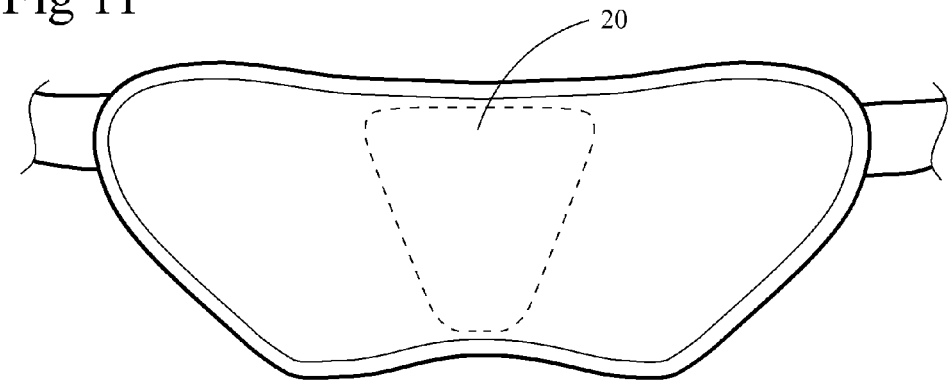
FIG. 11 shows an interior view of the embodiment shown in FIG. 10. The bottles are removed and the straps are not fully shown for simplicity of the drawing.
Figure 12:
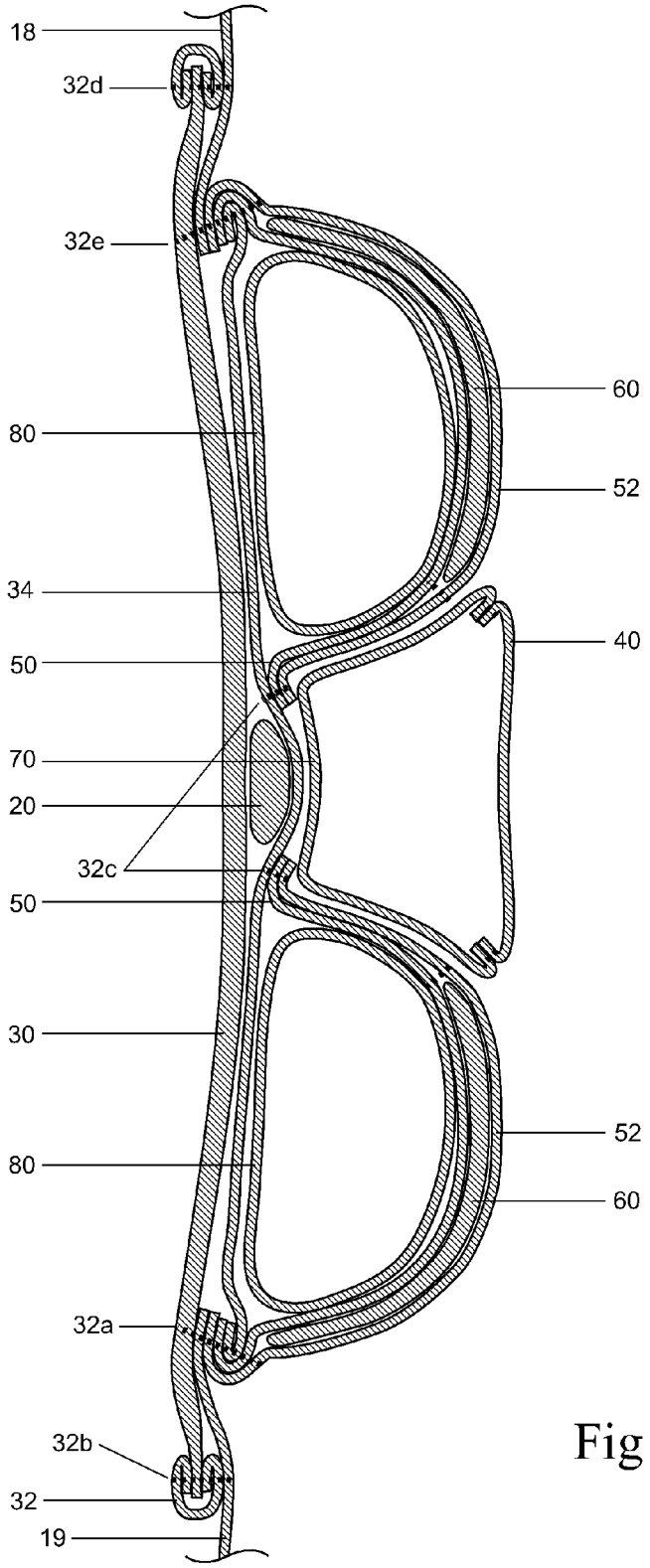
FIG. 12 is a sectional view taken along lines A2-A2 in FIG. 10.
Figure 13:
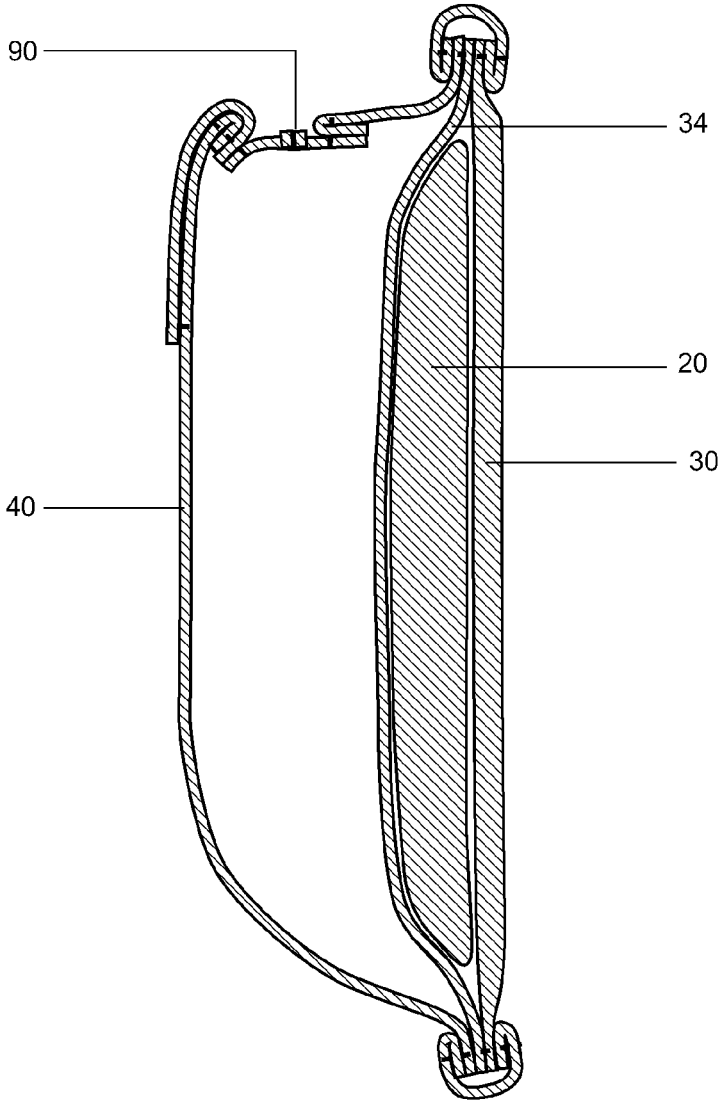
FIG. 13 is a sectional view taken along lines B2-B2 in FIG. 10.
Figure 14:
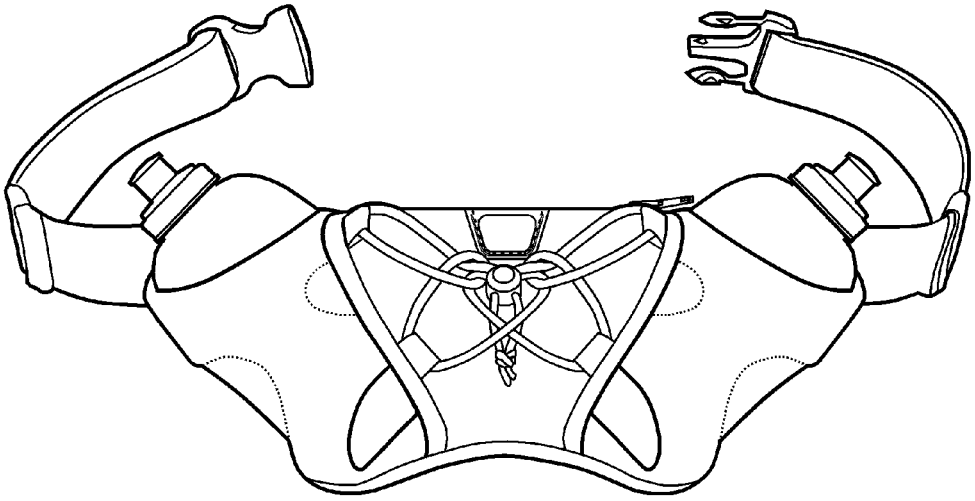
FIG. 14 illustrates an alternate embodiment of the invention with a large pocket, holsters for holding two bottles and a resilient hold-down strap for holding a jacket, gloves, or other accessory as shown.
Figure 15:
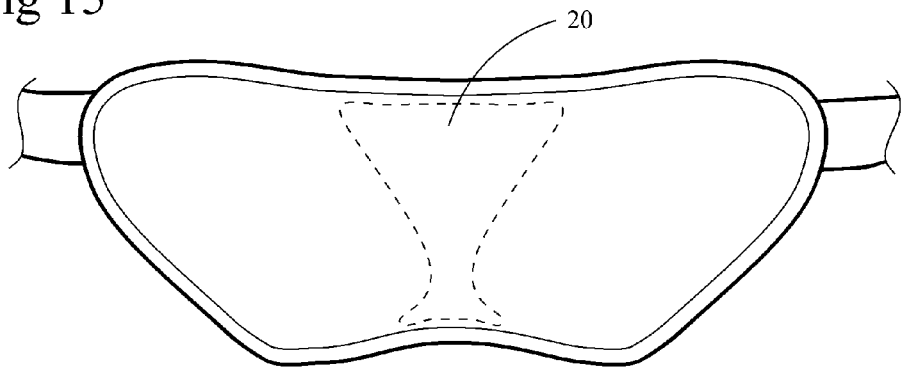
FIG. 15 shows an interior view of the embodiment shown in FIG. 15. The bottles are removed and the straps are not fully shown for simplicity of the drawing.

In alternate versions a pocket sidewall 70 is included. The pocket sidewall is preferably formed from ballistic or rip-stop nylon or the like (although could be a variety of materials from stretch mesh to leather or the like depending on the desired use/aesthetic, etc.). As best seen in FIG. 8, the pocket sidewall is secured between one end of the pocket front layer 40 and intermediate layer 34 to define a wedge-shaped interior pocket space.

The bottle holster is preferably formed such that the back panel comprises the back panel 30 and a first intermediate layer 34 as described above and the front panel includes a front layer 52 and an optional second intermediate layer 50. Preferably the second intermediate layer 52 is formed from rip-stop nylon (but it could be stretch denim, spandex or the like depending on the desired structure, durability, stretchiness, look, etc.). In some cases stretch denim or the like is preferably for this part because it can be stretched tightly to the interior padding layer 60.

The interior padding layer 60 is sandwiched between the second intermediate layer 50 and the front layer 52 of the bottle holster. Preferably padding layer 60 is formed from die-cut or the like polyethylene foam or the like commonly used in the trade or some other somewhat structural preferably foam or foamed material (preferably closed cell). This part preferably has some good thickness such as between about 0.125 to 0.5 inches thick. The thickness is dependent on a number of desired characteristics, structural requirements, aesthetics, etc. A preferable thickness in many cases is about 0.25 inches which provides a good structure, insulation, aesthetics, etc.

The front layer 52 of the bottle holster is preferably made from rip-stop nylon (but could be stretch denim, spandex or the like depending on the desired structure, durability, stretchiness, look, etc.). In some cases stretch denim or the like is preferred for this part because it can be stretched tightly to the preferably trapped inside preferably foam material.

Holster for Container/Bottle

The bottle holster is preferably preassembled and then can be assembled stitched or otherwise glued, formed or assembled integrally with the back panel portion. The holster is preferable made from a sandwich of three layers or panels in addition to the back panel 30 and first intermediate layer 34. Each panel is preferably die-cut to the desired shape and assembled together—an internal skin/liner layer (second intermediate layer 50) preferably made from rip-stop nylon or some other fabric (stretch fabric can be used like stretch denim, spandex, etc to get the desired stretched on look), a trapped layer (padding layer 60) of preferably polyethylene foam or the like structural/skeletal foam part, and a exterior skin layer (outer or front layer 52) of rip-stop nylon or the like or some other fabric (stretch fabric can be used like stretch denim, spandex, etc to get the desired stretched on look).

These layers can then be stitched together to form the desired holster shape and then assembled to the preferable waist straps, waist panel and accessory storage/pocket area. The padding layer 60 can be strategically formed/cut with side cutouts as shown in the drawings, substantially forming an hourglass or X-shape. The cutouts 16, 17 provide a skeletal structure for structurally supporting the container/bottle while eliminating weight as well as providing a grip area for the fingers and thumb for replacement of the bottle. Thus, the front layer 52 is stitched along a perimeter defined by the cutouts to provide recessed front edges along opposing sides of the bottle holster at a generally intermediate position along the sides of the bottle when the bottle is secured in the holster. A small opening 15 is provided at a bottom edge of the bottle holster with a larger opening at the opposite end. The large opening is sized to allow the bottle to pass through while the small opening is sized and shaped to prevent the bottle from passing through it while being large enough to accommodate a person's fingers. Accordingly, a person wearing the device can grasp the cutouts with a thumb and opposing finger while using another finger of the same hand to press on the bottle through the small opening and urge the bottle through the large opening and out of the holster.

Cut-outs in the holster can be alternatively formed as through-holes such that openings are provided in the regions defined by the stitching lines indicating the cutouts 16, 17. Alternately, the holster portion can be a pressure formed part with formed depressions and cutouts to achieve a similar result although in most cases pressure forming this part would produce a part that is most likely heavier (although in some cases pressure forming this part from sheet layer and/or layers could be desirable). Another benefit of the disclosed preferable holster geometry is that the geometry and placement of the through-hole substantially near the bottom of the holster eliminates or at least very substantially reduces an ejection force that is imparted on the bottle/container by the holster when the invention is worn around the waist of a user. This through-hole 15 is preferably formed such that it has a lip at the bottom to retain the bottle from falling out of the bottom of the holster. This bottom through-hole could also be formed as a cut-out indentation like the other disclosed cut-out indentations on the holster to reduce this bottle ejecting force, but more preferably it is formed open which almost completely removes said bottle ejection force when worn by a user.

Waist Panel & Padding

The interior padding layer 20 is represented in broken lines in FIGS. 2, 7, 11, and 15. The broken lines indicate an outline of the shape of the preferably polyurethane foam or the like part which is held in place preferably underlying the pocket portion of the invention and preferably not underlying the bottle portion. This foam part is preferably face glued fastened/trapped to the intermediate layer 34, fastened in place between layers of material or otherwise held, glued, sewed, etc in place such that it does not shift and stays in place underlying the pocket portion of the invention. It should be noted that the pocket portion could be eliminated and still achieve this tenting effect.

The padding layer generally provides a tenting effect adjacent the bottle holster and therefore is preferably placed adjacent the bottle but not under the bottle. In alternate versions, however, padding may be incorporated under the bottle, either partially or wholly. Likewise, though referred to as a "padding" layer for efficiency and because a padding type material is used in preferred versions, the layer itself need not perform a padding function. Rather, a principal purpose is to serve a tenting function in the intermediate layer 34, and therefore the padding layer provides a degree of separation between a portion of the intermediate layer and a portion of the back panel.

The particular shape of the padding layer or tenting layer can vary greatly depending on the configuration of the device. For example, the padding layer 20 may have a symmetrical wedge shape as in FIG. 11 or a wine glass shape as in FIG. 15 in order to accommodate bottle holsters adjacent the padding layer.

The waist panel of the preferred invention is preferably formed of a single panel of aerospacer mesh or the like wicking, cushioned fabric or some other panel or panels in combination, which provide the desired formation of a comfortable and somewhat cushioned waist panel. Waist straps are preferably fastened on either end of the waist panel. It should be noted that although the waist panel is preferably die-cut or otherwise formed from aerospacer or the like fabric (headliner, terrycloth, felt-like, or other similar comfort fabrics could potentially be used), the disclosed invention preferably used a comparably very thin back panel with comparatively minimal (could be almost no cushioning, although not as preferable) which allows the invention to be lightweight.

With the addition of the padding or spacer layer in areas that preferably do not extend between the container/bottle and the back panel, the disclosed invention creates an extremely comfortable and lightweight solution for carrying a container and accessory items. The placement of a strategically added cushioning/spacer area or areas situated substantially between the ends of preferable two waist straps which are preferably fastened to two ends the preferable waist panel, and this preferable local cushioned area not continuing between the bottle and the waist panel creates an even feeling of the waist panel against the body which provides for an extremely comfortably worn system for holding a bottle/container and accessories. This also provides for a substantially lighter product because a minimum of cushioning is used. The overall effect of the strategically placed, cut and/or formed foam/padding/cushioning or the like panel or panels/components or the like along with the other disclosed geometry and materials creates a surprisingly superior product (with advances in comfort, weight savings, material savings, cost, durability, usability, etc).

There are many ways that this preferably locally cushioned area could be achieved such as with die-cut and or formed polyurethane foam (pressure-formed, cut, layered or otherwise formed cushioning). Another means—although not as preferable in most cases because of added cost—of creating this locally cushioned area is to create a structured perimeter with a plastic, foam or foamed plastic or the like perimeter with tented breathable fabric held to its perimeter such that the locally tented area creates a cushioning effect much like hide is stretched on a two-sided drum. This preferably locally cushioned or tented area applies pressure to even out the waist panel such that when the invention is worn, no discernable pressure points from the container/bottle or other carried essentials in the storage area can be felt by the user and thus the weight of the carried item(s) is spread over a substantially flat and bump-free very comfortable and continuous feeling cushioned surface. The bottle/container bulge that potentially could be felt against the user on the waist panel is eliminated by the disclosed strategic placement of cushioning/tenting, because this strategically placed cushioning eliminates the ability for the user to feel this bottle bulge when the invention is worn (as mention the user only feels one very flat smooth cushioned continuous panel). Another advantage with having very little to no foam cushioning between the bottle and the waist panel is that this geometry brings the bottle closer to the user's body and thus bounces less and feels more integrated with the body. The preferable disclosed strategic positioning and confinement of cushioning along with the preferable substantially flattened container/bottle and the other disclosed geometry and materials create a surprisingly comfortable product.

Accessory Storage Pocket Panel

A pocket (or pockets) may be provided and affixed to the waist panel for carrying essential items. The pocket is adjacent the bottle holster and in certain preferred embodiments it overlies the padding or spacer layer 20. The pocket is preferably closed with a zipper 90 although could have other closure means and is preferably sewn glued or otherwise affixed to the waist panel such that it provides accessory storage means.

Bottle/Container

The preferable bottle/container 14 is preferably molded, formed, blow molded or otherwise constructed to contain liquid and has a cap or other opening. The preferable container/bottle has a surface that is somewhat flattened from the traditional round bottle cross-section (somewhat or substantially flattened at least on one side) and the bottle is placed in the holster as show in the drawings with a flattened surface facing toward the waist panel. The container/bottle is preferably formed/manufactured such that a substantial portion of this container/bottle achieves this somewhat or substantial flattened area (or more flattened than round, for the flattened area could have somewhat concave or even convex local areas used as finger grabs or other functional or aesthetic purposes). It should be noted that almost any shaped bottle or container could be placed in and work in the holster although the somewhat flattened shape is preferable.

Straps

There are certain functionally desirable properties of the belting system to allow it to function as a system to comfortably hold the retaining device or retaining devices to the body in a manner that is rigid yet comfortable, to control the undesirable bounce/movement of the system while in use, to allow it to function to hold the bottles and other objects being carried while encumbering the user in a manner that is as minimal (or non-existent) as possible. Minimizing weight, maximizing the allowable mobility of the user, holding the carried items in a manner that is rigid to the body so that they act as one with the body and do not bounce or feel encumbering (maximizing the comfort to the user) are the desirable characteristics of the belting (or the like) system to the user.

The main belt is preferably made of nylon webbing or the like or elastic, stretchy or somewhat stretchy, breathable, flexible webbing/belting examples of which are commonly found in the waist band of underwear, tights, compression tights, pants or the like also suspender strapping or the like. The main panel is sewn glued, grommeted or attached to the belt in other ways such as with hook and loop Velcro or the like. Alternatively, nylon, cotton, polypropylene or the like webbing could be used in another embodiment as well as a strip or strips of other fabric made of cotton, nylon, polyester or other natural or synthetic fiber materials or blends in combination with webbing, material, mesh or the like or by itself. Also although not preferable a strip or strips of leather, plastic or leather-like material or materials could be used for the main belt.

Other versions use somewhat flexible but not stretchy nylon, polypropylene webbing or the like integrated with a portion of stretch material (like elastic webbing, rubber, bungee material or the like) to get a desired controlled stretch to move with the users breathing yet not allow too much stretch that would allow the carried items to bounce during jarring activities.

Because in some cases stretch is desired for flexibility of the belt but too much stretch allows the carried items on the belt to bounce during jarring or somewhat jarring activities a stretch limiter can incorporated into the belt system or the like to allow a controlled amount of stretch. Also low stretch materials can be used for the belting to allow a little flexibility but not too much so that bounce of carried items is limited.

Attached to part, portions, or all of the length of the main belt optionally is a strip, strips or pieces of non-stretchy or somewhat non-stretchy webbing, ribbon or other fabric, strip, or element. This element is incorporated to control (or limit stretch). This stretch limiting element or elements is preferably made of non-stretchy or somewhat non-stretchy webbing, ribbon, nylon fabric or the like but also could be accomplished in other ways such by sewing areas with non-stretchy or somewhat non-stretchy thread or sewing, gluing, or otherwise attaching non-stretchy or somewhat non stretchy elements made of plastic, leather, vinyl, nylon or the like. Also hook and/or loop or the like material can be sewn glued, heat applied or otherwise affixed along the length or portions of the length to accomplish a similar stretch-limiting/controlling result and can have other uses for example being part or parts of the fastening closure for holding the belt on the user.

In another embodiment the stretch limiter portion of the belt can be assembled to the somewhat stretchy portion of the belt by stretching one side and sewing the limiter in place. The opposite side is relaxed and then sewn in place so the belt will curve. This curve or somewhat curved belt geometry can be desirable for users that have smaller waists with respect to hips providing for some users a more comfortable fit.

Although less preferable for some uses the stretch limiter could be eliminated and a stretch belt could be used. This may be desirable for carrying light loads on the belt or if a low stretch belt/elastic is used. The stretch-limiter is preferably sewn around its perimeter to the base preferably stretchy belt although it can be sewn at its ends or strategically in certain areas and not in other to provide functional elements (for example loop areas could be left un-sewn similar to an ammunition belt).

Pockets or the like can be added or incorporated into the belting system to carry items or the like. Pockets can be integrated into the belt itself (sewn, snapped, buttoned, fastened with Velcro or the like or otherwise attached).

The belt system herein disclosed is preferably size-adjustable to fit a variety of body types and sizes. Adjusting for size can be accomplished many ways. A common traditional buckle with integrated or separate adjusters is preferably used to buckle the belting system in place on the body. Hook and loop fabric/strapping can also be incorporated into the belt in such a way that the belt system is not only remateable but also adjustable to fit a variety of sizes.

Accordingly the preferred system creates a desired solution of a bottle and/or accessory carrying device, doing so with a minimum of material and weight and creating a solution that is very comfortable and seamlessly worn on the body for a variety of used from light recreation to heavy sport, running, marathon or other jarring and/or vigorous use or any other use where comfort and minimal impedance/impact on the body are desired.

The system can be fabricated in a manner that is extremely lightweight and durable. It can be worn comfortably with a very minimal impact to the user, eliminating uncomfortable pressure points, bouncing, shifting and chafing, can be manufactured simply and inexpensively, using a minimum of material efficiently, can be configured such that it has a minimal on-body footprint which is favorable for hot, humid and other conditions that may cause a user to perspire, and can be configured in a manner that is highly breathable.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A bottle carrier, comprising:

a back panel having a waist belt for securing the back panel to the waist of a user;

an intermediate panel having a first end, a second end, and a central region, the intermediate panel being secured to the back panel at the first end and at the second end but the central region not being fixed directly to the back panel;

a first bottle holster configured to receive and retain a bottle, the bottle holster being secured to the intermediate panel to define a first portion of the intermediate panel to which a bottle is secured and a second portion of the intermediate panel, the second portion not lying between the bottle and the back panel when the bottle is retained by the first bottle holster; and a spacer permanently secured along and between the second portion of the intermediate panel and the back panel, the spacer being positioned such that it is not between the first portion of the intermediate panel and the back panel, whereby the spacer provides a relatively greater distance between the intermediate panel and the back panel at the second portion of the intermediate panel than the distance between the intermediate panel and the back panel at the first portion of the intermediate panel, and further wherein no additional spacer is provided between the first portion of the intermediate panel and the back panel.

2. The bottle carrier of claim 1, further comprising a second bottle holster configured to receive and retain an additional bottle, the second bottle holster being secured to the intermediate panel to define a third portion of the intermediate panel underlying the second bottle holster, the second portion of the intermediate panel further being defined between the first portion and the third portion.

3. The bottle carrier of claim 2, wherein the carrier comprises an upper end and a lower end, the spacer being wider adjacent the upper end and narrowing as it extends away from the upper end.

4. The bottle carrier of claim 1, wherein the intermediate panel is not secured to the back panel between the first end and the second end.

5. A bottle carrier, comprising:

a first panel having a waist belt for securing the first panel to the waist of a user, the waist belt having a first end and a second end, the first end being configured to releasably fasten to the second end;

a second panel having a first end and a second end and defining a perimeter, the second panel being secured to the first panel at the first end and the second end along at least a portion of the perimeter;

a bottle holster configured to receive and retain a bottle, the bottle holster having an upper opening, a bottom, a first lateral side, and a second lateral side, the bottle holster further being secured to the second panel along the first lateral side generally adjacent the first end of the second panel and being secured to the second panel along the second lateral side at a location generally intermediate the first end and the second end of the second panel; and a spacer permanently secured along and between the first panel and the second panel and lying substantially beyond the second lateral side of the bottle holster in a direction from the first end of the belt toward the second end of the belt, the portion of the spacer lying between the first panel and the second panel having a shape that is widest along an upper end of the spacer, and narrowing as it extends away from the upper end of the spacer at least toward an intermediate location along the spacer, and further wherein no additional spacer is provided between the first portion of the intermediate panel and the back panel.

6. The bottle carrier of claim 5, wherein the second panel extends laterally beyond the bottle holster to define a first portion of the second panel underlying the bottle holster and a second portion of the second panel extending laterally beyond the bottle holster, and further wherein the spacer is sized and shaped to underlie substantially the entirety of the second portion of the second panel without underlying any portion of the first portion of the second panel.

7. The bottle carrier of claim 6, wherein the bottle holster further comprises at least one indentation along at least one of the first lateral side or second lateral side.

8. The bottle carrier of claim 7, wherein the bottle holster further comprises a bottom opening at the bottom, the bottom opening being large enough to receive a finger of the user but sufficiently small to prevent the bottle from passing through.

9. The bottle carrier of claim 6, wherein the spacer is formed from a padding material that is stitched in place between the first panel and the second panel.

10. The bottle carrier of claim 6, wherein the second panel is not secured to the first panel at any location within the perimeter.

11. The bottle carrier of claim 6, further comprising a pocket overlying the second portion of the second panel.

12. The bottle carrier of claim 6, wherein the spacer is formed from a padding material that is glued in place between the first panel and the second panel.

13. A bottle carrier, comprising:

a main body having a back panel, the main body having a waist belt for securing the main body to the waist of a user, the waist belt having a first end and a second end, the first end being configured to releasably fasten to the second end;

a bottle holster carried on the main body, the bottle holster being configured to receive and retain a bottle;

an intermediate panel, the intermediate panel having a first portion lying between the back panel and the bottle holster and a second portion extending beyond the bottle holster;

the bottle holster further having an upper opening bounded by a first side and a second side;

a first fastener joining the first side of the bottle holster, the intermediate panel, and the back panel;

a second fastener joining the second side of the bottle holster to the intermediate panel without joining the second side of the bottle holster to the back panel; and a spacer secured along and between the second portion of the intermediate panel and the back panel, the spacer being positioned laterally adjacent the bottle holster such that when the bottle carrier is worn about the waist of the user the spacer is not positioned between the bottle holster and the back panel, and further wherein no additional spacer is provided between the first portion of the intermediate panel and the back panel.

14. The bottle carrier of claim 13, wherein the back panel further comprises a back panel perimeter and the intermediate panel further comprises an intermediate panel perimeter, the intermediate panel perimeter lying adjacent the back panel perimeter, and further wherein the spacer is permanently secured by glue or stitching.

15. The bottle carrier of claim 14, wherein the first portion of the intermediate panel is defined by and underlies substantially the entirety of the bottle holster and the spacer is sized and shaped to underlie substantially the entirety of the second portion of the intermediate panel, the spacer having a perimeter on the main body, the perimeter forming a wedge shape.

16. The bottle carrier of claim 15, wherein the intermediate panel further comprises an intermediate boundary between the first portion and the second portion, the intermediate panel being secured to the back panel at a first perimeter edge and an opposite second perimeter edge but not being secured to the back panel along the intermediate boundary.

17. The bottle carrier of claim 16, wherein the bottle holster further comprises a main opening, a bottom, and opposing lateral sides, the bottle holster further having at least one cutout along at least one of the opposing lateral sides.

18. The bottle carrier of claim 17, wherein the bottle holster further comprises a bottom opening at the bottom, the bottom opening being large enough to receive a finger of the user but sufficiently small to prevent the bottle from passing through.

19. The bottle carrier of claim 15, wherein the spacer layer is formed from a padding material, and further wherein the main body comprises an upper end and a lower end, the wedge shape of the spacer being wider adjacent the upper end and narrower toward the lower end.

20. The bottle carrier of claim 15, further comprising a pocket overlying the second portion of the intermediate layer.

* * * * *